US008120253B2

(12) United States Patent
Nam et al.

(10) Patent No.: US 8,120,253 B2
(45) Date of Patent: Feb. 21, 2012

(54) PLASMA DISPLAY PANEL

(75) Inventors: Mun-Ho Nam, Suwon-si (KR); Jun-Yong Park, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 295 days.

(21) Appl. No.: 12/274,964

(22) Filed: Nov. 20, 2008

(65) Prior Publication Data

US 2009/0128035 A1 May 21, 2009

(30) Foreign Application Priority Data

Nov. 20, 2007 (KR) ..... 10-2007-0118519

(51) Int. Cl.
*H01J 17/49* (2006.01)

(52) U.S. Cl. ..... 313/587; 313/582

(58) Field of Classification Search ..... 313/582–587; 445/23–25; 345/60
See application file for complete search history.

(56) References Cited

U.S. PATENT DOCUMENTS

2006/0244380 A1* 11/2006 Yoshinari et al. ..... 313/582
2007/0013306 A1* 1/2007 Hai et al. ..... 313/582
2007/0228973 A1* 10/2007 Soh et al. ..... 313/584

FOREIGN PATENT DOCUMENTS

JP 11-45663 2/1999
JP 2004-6307 A 1/2004

OTHER PUBLICATIONS

KIPO action dated Jun. 12, 2009, for priority Korean Patent Application No. 10-2007-0118519, noting reference(s) listed in this IDS, 5 pgs.
SIPO Office action dated Mar. 30, 2011, for corresponding Chinese Patent application 200810176344.2, noting listed reference in this IDS, as well as U.S. Publications cited in Office action dated Sep. 15, 2010.
English machine translation of Japanese Publication 11-45663, listed above, 16 pages.

* cited by examiner

*Primary Examiner* — Joseph L Williams
(74) *Attorney, Agent, or Firm* — Christie, Parker & Hale, LLP

(57) ABSTRACT

A plasma display panel (PDP) with improved address voltage margin and reduced noise brightness such as discharge light or background light during an address discharge. The PDP includes a plurality of barrier ribs between a front substrate and a rear substrate to define a plurality of main discharge spaces and a plurality of auxiliary discharge spaces along a stepped surface of the barrier ribs. The auxiliary discharge spaces provide a shorter discharge path than the main discharge spaces. Address electrodes are provided on the rear substrate for generating address discharges together with the scan electrodes on the front substrate at locations adjacent to the auxiliary discharge spaces. Phosphor layers are respectively formed in the main discharge spaces, and a discharge gas is injected in the main discharge spaces and the auxiliary discharge spaces.

17 Claims, 11 Drawing Sheets

PLASMA DISPLAY PANEL

CROSS-REFERENCE TO RELATED PATENT APPLICATION

This application claims priority to and the benefit of Korean Patent Application No. 10-2007-0118519, filed on Nov. 20, 2007, in the Korean Intellectual Property Office, the disclosure of which is incorporated herein in its entirety by reference.

BACKGROUND OF THE INVENTION

1. Field of the Invention

The present invention relates to a plasma display panel (PDP), and more particularly, to addressing operations of a PDP.

2. Description of the Related Art

In a PDP, a plurality of discharge cells arranged as a matrix are interposed between upper and lower substrates that face each other. Discharge electrodes including scan electrodes and sustain electrodes for generating a discharge between them are formed on the upper substrate, and a plurality of address electrodes are formed on the lower substrate. The upper substrate and the lower substrate are bonded together to face each other, a predetermined discharge gas is injected between the upper and lower substrates, and phosphors coated in the discharge cells are excited by generating a predetermined discharge pulse between the discharge electrodes so as to generate visible light, thereby realizing a desired image.

In order to realize gradation (e.g., colors, gray levels, or brightness) of images in the PDP, an image frame is divided into several sub-fields each having a different light emission level, thereby performing time-division driving of the PDP. Each of the sub-fields is divided into a reset period to uniformly generate discharges, an address period to select discharge cells, and a sustain period to realize gradation of images according to the number of discharges. In the address period, a kind of auxiliary discharges are generated between the address electrodes and the scan electrodes, and wall voltages are formed in the selected discharge cells so as to form a suitable environment for sustain discharges.

In general, in the address period, a higher voltage is required for an address discharge as compared to a sustain discharge. Reducing an input voltage (that is, the address voltage) for addressing and ensuring a sufficient voltage margin are essential for improving the driving efficiency of the PDP and for increasing discharge stability. Moreover, with the development of display devices such as full-HD resolution devices, the power consumption required in a circuit board increases as the number of address electrodes allotted for discharge cells is increased in proportion to the number of discharge cells. In addition, a high xenon (Xe) display, in which a partial pressure of Xe in the discharge gas injected into the inside of the PDP is increased, has high luminous efficiency but requires a relatively high address voltage for firing a discharge. Thus, in order to realize a high-efficiency PDP display, a sufficient address voltage margin should be provided.

SUMMARY OF THE INVENTION

Embodiments of the present invention provide a PDP with sufficient address voltage margin by reducing an electrical property difference between mixed phosphors.

Embodiments of the present invention provide a high-quality, high contrast display wherein noise brightness such as discharge light or background light is removed or reduced during an address discharge, except for light emission.

According to one embodiment of the present invention, there is provided a plasma display panel (PDP) including a first substrate and a second substrate facing each other; a plurality of barrier ribs on the second substrate between the first substrate and the second substrate forming a plurality of main discharge spaces and a plurality of auxiliary discharge spaces along a stepped surface of the barrier ribs; pairs of scan electrodes and sustain electrodes extending on the first substrate, the scan electrodes at locations overlapping with or adjacent to the auxiliary discharge spaces; a plurality of address electrodes for generating address discharges together with the scan electrodes; a plurality of phosphor layers respectively in the main discharge spaces; and a discharge gas in the main discharge spaces and the auxiliary discharge spaces.

Each of the barrier ribs may include a base unit and a protrusion unit protruding from the base unit, and the base unit may have a relatively large width in comparison to a width of the protrusion unit.

The barrier ribs may face the scan electrodes, and the auxiliary discharge space may be formed therebetween.

An electron emission material layer may be formed on the stepped surface of the barrier ribs. The electron emission material layer may also extend to the main discharge spaces. In addition, the electron emission material layer may continuously extend between the main discharge spaces and the auxiliary discharge spaces. The phosphor layers may respectively be on sections of the electron emission material layer in the main discharge spaces.

The main discharge spaces and the auxiliary discharge space may be adjacent and contiguous.

According to another embodiment of the present invention, there is provided a PDP including a first substrate and a second substrate facing each other; a plurality of barrier ribs on the second substrate between the front substrate and the rear substrate forming a plurality of main discharge spaces; pairs of scan electrodes and sustain electrodes extending on the first substrate; a dielectric layer covering the pairs of scan electrodes and sustain electrodes and having a plurality of grooves forming a plurality of auxiliary discharge spaces at locations overlapping with or adjacent to the scan electrodes; a plurality of address electrodes for generating address discharges together with the scan electrodes; a plurality of phosphor layers respectively in the main discharge spaces; and a discharge gas in the main discharge spaces and the auxiliary discharge spaces.

The barrier ribs may face the scan electrodes, and the auxiliary discharge spaces may be formed therebetween.

An electron emission material layer may be on top surfaces of the barrier ribs, the electron emission material layer defining the auxiliary discharge spaces. Also, the electron emission material layer may extend to the main discharge spaces. In addition, the electron emission material layer may continuously extend between the main discharge spaces and the auxiliary discharge spaces. The phosphor layers may be respectively formed on sections of the electron emission material layer in the main discharge spaces.

The main discharge spaces and the auxiliary discharge spaces may be adjacent and contiguous.

According to still another embodiment of the present invention, there is provided a PDP including a first substrate and a second substrate facing each other; a plurality of barrier ribs on the second substrate between the first substrate and the second substrate, each of the barrier ribs including a base unit and forming a plurality of cells and a protrusion unit protruding from a part of the base unit, wherein a width of the protrusion unit is narrower than a width of the base unit; pairs of scan electrodes and sustain electrodes alternately arranged on the first substrate; a plurality of phosphor layers respectively located at at least a part of the plurality of cells; and a discharge gas in the plurality of cells. The scan electrodes overlap with at least parts of the base units The protrusion unit protrudes from a part of the base unit that is distant from a center of an adjacent cell among the plurality of cells.

According to yet another embodiment of the present invention, there is provided a PDP including a first substrate and a second substrate facing each other; a plurality of barrier ribs on the second substrate between the first substrate and the second substrate forming a plurality of cells; pairs of scan electrodes and sustain electrodes extending on the first substrate; a dielectric layer covering the pairs of scan electrodes and sustain electrodes and having grooves at locations overlapping with or adjacent to the scan electrodes; a plurality of phosphor layers respectively located at at least a part of each of the plurality of cells; and a discharge gas filled in the plurality of cells.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION OF EXEMPLARY EMBODIMENTS

Hereinafter, embodiments of the present invention will now be described more fully with reference to the accompanying drawings, in which exemplary embodiments of the invention are shown.

First Embodiment

Figure 1:
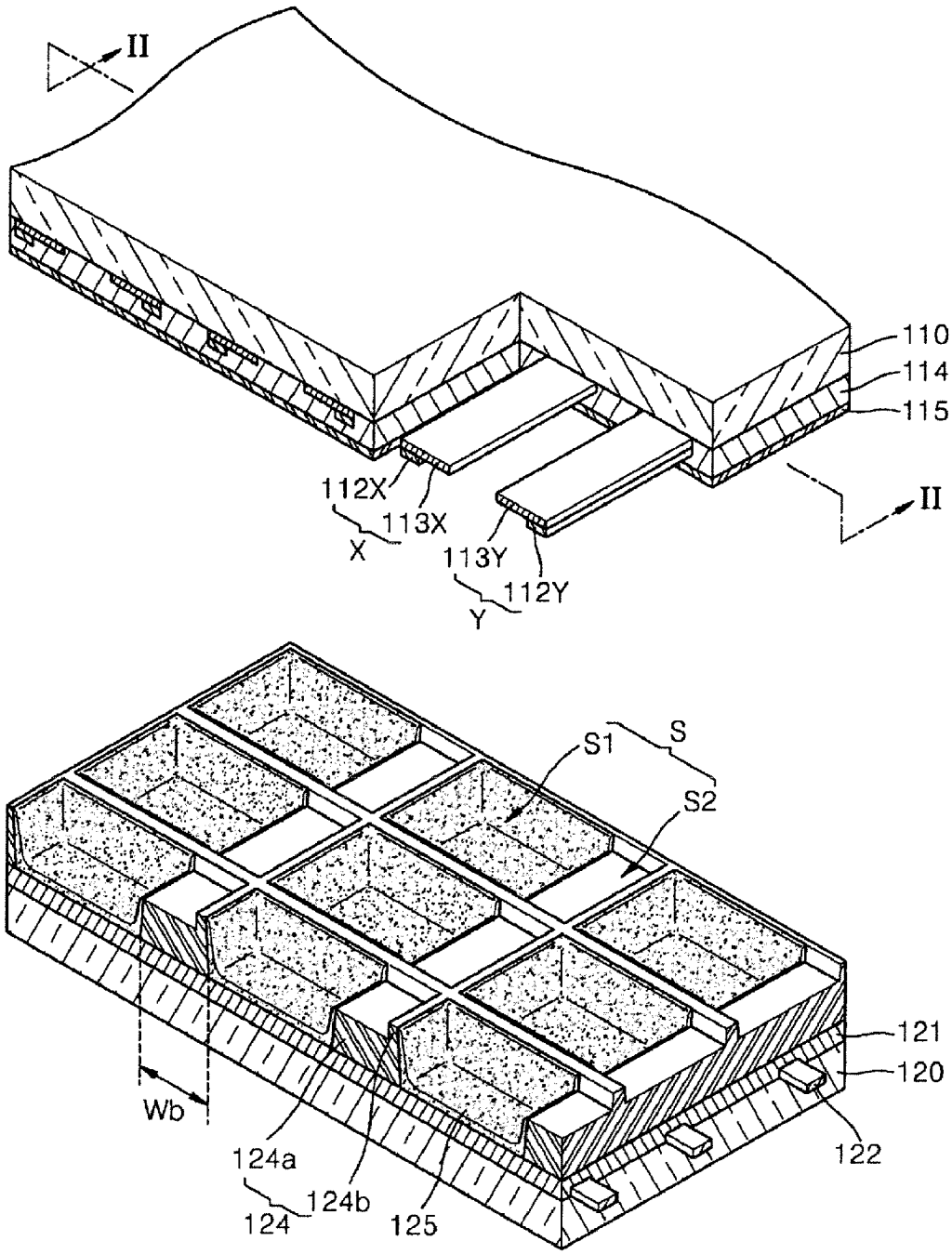
FIG. 1 is an exploded perspective view illustrating a plasma display panel (PDP) according to a first embodiment of the present invention.
Figure 2:
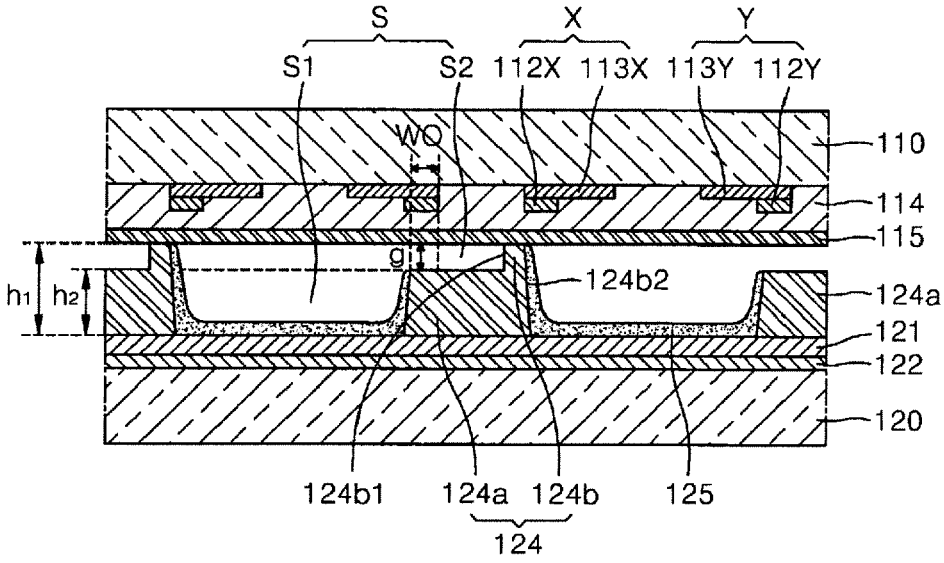
FIG. 2 is a vertical cross-sectional view of the PDP of FIG. 1, taken along the line II-II.
Figure 3:
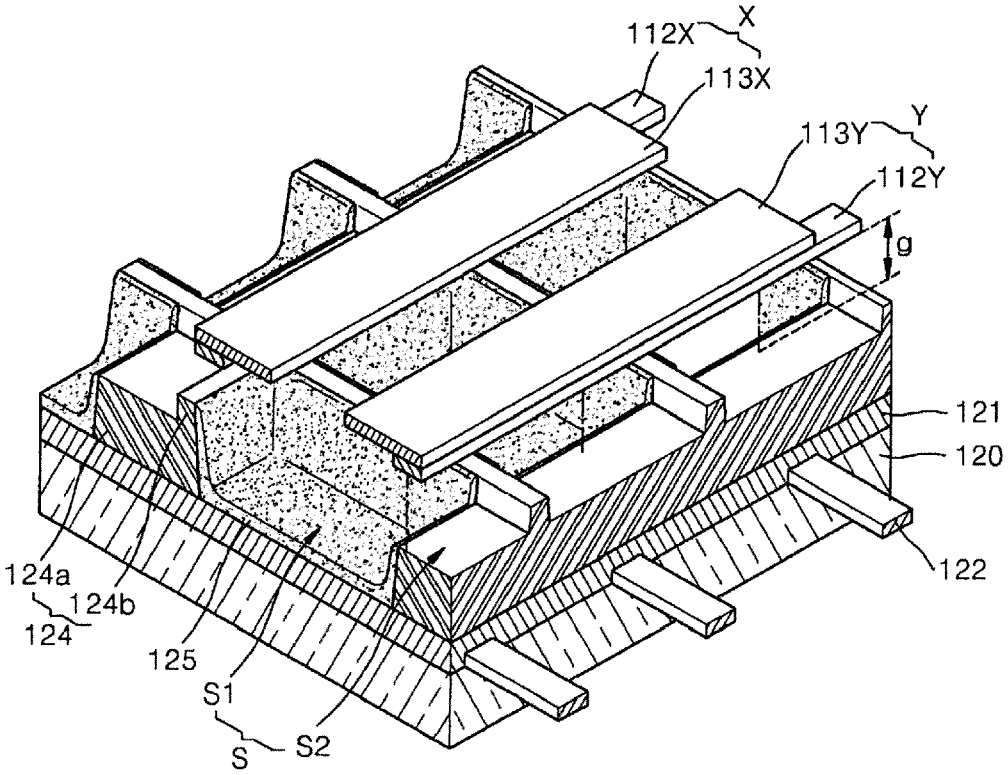
FIG. 3 is a perspective view illustrating the arrangement of the components of the PDP illustrated in FIG. 1.

FIG. 1 is an exploded perspective view illustrating a plasma display panel (PDP) according to a first embodiment of the present invention. FIG. 2 is a vertical cross-sectional view of the PDP of FIG. 1, taken along the line II-II. FIG. 3 is a perspective view illustrating the arrangement of the components of the PDP illustrated FIG. 1. The PDP of FIG. 1 includes a front substrate 110 and a rear substrate 120, which are separated to face each other, and a plurality of barrier ribs 124 for partitioning a space between the front substrate 110 and the rear substrate 120 into a plurality of unit cells S. The unit cell S is a smallest light-emitting unit in which a pair of sustain electrodes X and Y generate a display discharge between them and in which an address electrode 122 extends to cross the pair of sustain electrodes X and Y, and the unit cells S are defined by the barrier ribs 124, thereby realizing a display. Each of the unit cells S constitutes an independent light emitting area. The sustain electrodes X and Y represent respectively a sustain electrode X and a scan electrode Y. Each of the sustain electrodes X and Y may respectively include bus electrodes 112X and 112Y, which constitute power lines for supplying driving power, and transparent electrodes 113X and 113Y that are formed of a conductive transparent material. The transparent electrodes 113X and 113Y extend inside the unit cell S and respectively form electrical contacts with the bus electrodes 112X and 112Y. The pair of sustain electrodes X and Y may be covered with a dielectric layer 114 so as not to be directly exposed to a discharge environment, thereby being protected from direct collision with charged particles during a discharge. The dielectric layer 114 may be covered with a protective layer 115 including, for example, an MgO thin film. The protective layer 115 may induce emission of secondary electrons, thereby serving to activate the discharge.

The address electrode 122 is disposed on the rear substrate 120. The address electrode 122 performs an address discharge with the scan electrode Y. The address discharge represents a kind of auxiliary discharge that supports a display discharge by accumulating priming particles in each of the unit cells S before the display discharge occurs, thereby firing the display discharge. The address discharge occurs mainly in an auxiliary discharge space S2 that is formed by the barrier ribs 124. That is, the scan electrode Y and the address electrode 122 cross each other across the auxiliary discharge space S2 or at least at a location adjacent to the auxiliary discharge space S2, and a discharge voltage applied therebetween converges in the auxiliary discharge space S2 via the dielectric layer 114 covering the scan electrode Y and the barrier rib 124 on the address electrode 122, so that a high electric field that is sufficient to fire the discharge is formed in the auxiliary discharge space S2. The auxiliary discharge space S2 is not separately created by a wall structure but extends from a main discharge space S1, thereby forming a space along with the main discharge space S1. The priming particles formed in response to the address discharge in the auxiliary discharge space S2 diffuse to the main discharge space S1 and participate in the display discharge. The auxiliary discharge space S2 is defined by the barrier ribs 124 that have a step difference with the main discharge space S1, and has a discharge volume smaller than that of the main discharge space S1.

The address electrode 122 may be covered with a dielectric layer 121 formed on the rear substrate 120, and the barrier ribs 124 may be formed on a flat surface of the dielectric layer 121. Corresponding to a unit cell S, the barrier ribs 124 include a base unit 124*a* having a wide width on the rear substrate 120 and separated from the front substrate 110 by a gap (e.g., a predetermined gap), and a protrusion unit 124*b* having a narrow width and protruding from a location (e.g., a location no top surface near an edge) on the base unit 124*a* toward the front substrate 110, such that the barrier ribs 124 has a stepped shape in the unit cell S. The stepped shape of the barrier ribs 124 in the unit cell S defines the auxiliary discharge space S2 in which the address discharge is generated, wherein the stepped shape is formed from a top surface of the base unit 124*a* to the protrusion unit 124*b*. In order to store sufficient wall charges via the address discharge, the auxiliary discharge space S2 should have a volume that can hold an amount of discharge gas over a critical volume. The volume of the auxiliary discharge space S2 is determined according to an aspect ratio of the base unit 124*a* and the protrusion unit 124*b* that are parts of the barrier ribs 124. For example, when the protrusion unit 124*b* is too thin, it may create structural stability problems, and therefore, a width Wb of the base unit 124*a* may be large as compared to the width of the protrusion unit 124*b*. For example, a width of a barrier rib in an exemplary 50-inch full-high definition (HD) PDP television is 30-40 μm, the width Wb of the base unit 124*a* of the barrier ribs 124 may be equal to 60-80 μm, which is twice as wide as the width of the barrier rib in the exemplary PDP television. If the width Wb of the base unit 124*a* is excessively increased so as to exceed a proper range for a standard panel size, the discharge volume of the main discharge space S1 is relatively decreased so that brightness may deteriorate. A vertical height of the protrusion unit 124*b* associated with the volume of the auxiliary discharge space S2 should be over a critical value, e.g., 30 μm. The vertical height of the protrusion unit 124*b* corresponds to a discharge path of the address discharge, thereby affecting a firing voltage, and thus, the vertical height may be designed so as not to exceed a proper range, considering power consumption and allowed circuit rating.

The address electrode 122 and the scan electrode Y may cross each other across the auxiliary discharge space S2 or at least at the location adjacent to the auxiliary discharge space S2 so that the address discharge converges in the auxiliary discharge space S2. Here, the discharge voltage applied between the scan electrode Y and the address electrode 122 cause the address discharge through a discharge gap g between the dielectric layer 114 (or the protective layer 115) and the base unit 124*a*, to which an electric field of the scan electrode Y and an electric field of the address electrode 122 respectively reach. In order to shorten the discharge path of the address discharge, the scan electrode Y and the base unit 124*a* may be disposed to overlap each other, and in some embodiments, the scan electrode Y and the base unit 124*a* may be disposed so as to form width WO that is overlapping between the scan electrode Y and the base unit 124*a*.

The address discharge generated in the auxiliary discharge space S2 serves to supply the priming particles for firing the display discharge and does not directly provide light emission. When discharge light unavoidably occurring during the address charge is leaked with the light emission, the discharge light creates blurry noise brightness around an emitting pixel, thereby causing deterioration of the resolution of a display. Thus, in order to block the discharge light generated in the auxiliary discharge space S2, a black stripe (not shown) formed on the auxiliary discharge space S2 may be considered as a solution. However, in general, the bus electrode 112Y, which is a part of the scan electrode Y, may be made of a metallic conductive material, and thus, may directly block the light. Hence, forming the black stripe may not be essential. In this regard, according to the first embodiment of the present invention, since the main discharge space S1 for the display charge and the auxiliary discharge space S2 for the address charge are located at different locations, the discharge light can be easily blocked. Applying the black stripe to a selected location may be one option for blocking the discharge light generated in the auxiliary discharge space S2. However, in conventional technology, the display discharge and the address discharge are generated at the same location, and thus, blocking the discharge light is actually impossible or very difficult, thereby causing deterioration of display quality. In particular, in the conventional technology, visible light generated by phosphor excited by the address discharge creates background light that causes deterioration of a contrast characteristic of a display.

The first embodiment of the present invention structurally excludes a phosphor layer from the auxiliary discharge space S2 to which the address discharge converges, and thus, the background light caused by light emission due to phosphor excitation during an address discharge can be removed from the auxiliary discharge space S2, and thus an HD display having high contrast can be realized.

A phosphor layer 125 is formed over an inner wall of the main discharge space S1. For example, the phosphor layer 125 may be formed to cover the dielectric layer 121, a second side 124*b*2 of the protrusion unit 124*b*, and a side of the base unit 124*a* of the barrier ribs 124. The phosphor layer 125 interacts with ultraviolet light generated from the display discharge, thereby generating visible light of different colors. For example, by coating red (R), green (G), and blue (B) phosphors in the main discharge space S1, each main discharge space S1 or each of the unit cells S corresponds to one of the R, G, or B subpixels. The phosphor layer 125 is not coated on a top surface of the base unit 124*a* of the barrier ribs 124 and on a first side 124*b*1 of the protrusion unit 124*b* in contact with the auxiliary discharge space S2. Different phosphors including different materials have different electrical properties that may affect a sensitive discharge environment. For example, a surface potential of a G phosphor, which is based on zinc silicate such as Zn2SiO4:Mn, has a tendency to be charged with negative charges, while R and B phosphors such as Y(V,P)O4:Eu or BAM:Eu, etc., have a tendency to be charged with positive charges. Thus, in order to prevent or reduce the occurrence of a discharge interference of the phosphors and to form a uniform discharge environment, the phosphor is separated from a path for the address discharge. This is the reason why the phosphor layer 125 is not coated inside the auxiliary discharge space S2. In a conventional PDP, the phosphor is directly exposed to the environment for the address discharge, and thus, even when a uniform address voltage is applied to discharge spaces, voltages actually applied inside the discharge spaces may have variations according to an electrical property of the phosphor in the discharge spaces. That is, G phosphor (which has a tendency to be charged with negative charges) serves to decrease the address voltage while R and B phosphors (which have a tendency to be charged with positive charges) serve to increase the address voltage, and therefore, the voltages applied inside the discharge spaces are varied although the uniform address voltage is applied to the discharge spaces. As a result, the address voltage margin is reduced.

According to the first embodiment, the main discharge space S1, in which the display discharge is mainly performed, is separated from the auxiliary discharge space S2, in which the address discharge is mainly performed, and the phosphor is not coated in the auxiliary discharge space S2. Therefore, the address voltage applied from outside of the PDP may be uniformly transferred to each auxiliary discharge space S2 without being distorted by electrical property of the phosphor, and thus, the address voltage margin may be greatly increased. Compared to the conventional technology, the same address discharge effect may be obtained with a lower address voltage, and also, when the same address voltage is used, more priming particles may be stored and a discharge intensity in the subsequent display discharge may be increased.

The discharge gas is injected, as a source for generating ultraviolet light, inside the main discharge space S1 and the auxiliary discharge space S2. A multi-component gas, in which xenon (Xe), krypton (Kr), helium (He), neon (Ne), etc., capable of emitting suitable ultraviolet light by a discharge excitation are mixed in a suitable proportion by volume (e.g., a predetermined proportion), may be used as the discharge gas. A conventional method of using a high Xe discharge gas, in which a Xe mixture proportion is increased, has a high luminous efficiency. However, the conventional method requires a high firing voltage, thereby causing increase of driving power consumption, circuit re-design for increasing nominal power, etc. Considering the aforementioned problems, use of the conventional method is limited. According to the first embodiment of the present invention in which the address voltage margin is increased, sufficient priming particles for firing the discharge may be obtained, so that a high Xe PDP with increased luminous efficiency can be realized.

Second Embodiment

Figure 4:
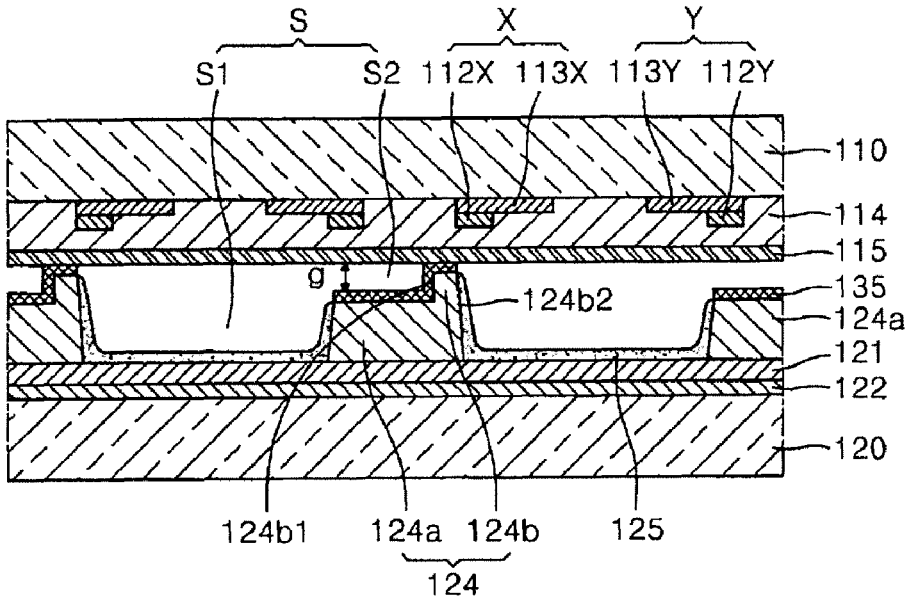
FIG. 4 is a vertical cross-sectional view of a PDP according to a second embodiment of the present invention.

FIG. 4 is a vertical cross-sectional view of a PDP according to a second embodiment of the present invention. Referring to FIG. 4, a plurality of barrier ribs 124 are interposed between a front substrate 110 and a rear substrate 120 which face each other so that main discharge spaces S1 are defined, and auxiliary discharge spaces S2 are formed on a stepped surface of the barrier ribs 124. In the second embodiment, an electron emission material layer 135 is coated on a surface including a top surface of a base unit 124*a* and a first side 124*b*1 of a protrusion unit 124*b*, and, together with a protective layer 115, defines the auxiliary discharge space S2. For example, the electron emission material layer 135 may include MgO nano powder, Sr—CaO thin film, carbon powder, metal powder, MgO paste, ZnO, BN, MIS nano powder, OPS nano powder, ACE, CEL, etc. The electron emission material layer 135 reacts with a high electric field converging into the auxiliary discharge space S2 and supplies secondary electrons to the auxiliary discharge space S2, thereby activating and accelerating firing of a discharge.

Third Embodiment

Figure 5:
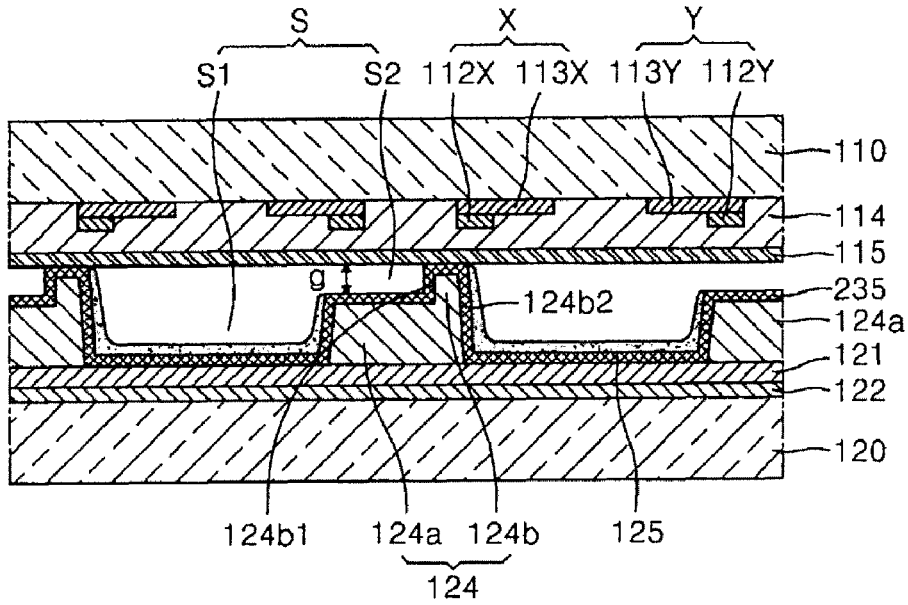
FIG. 5 is a vertical cross-sectional view of a PDP according to a third embodiment of the present invention.

FIG. 5 is a vertical cross-sectional view of a PDP according to a third embodiment of the present invention. Referring to FIG. 5, a plurality of barrier ribs 124 are interposed between a front substrate 110 and a rear substrate 120 which face each other so that a main discharge spaces S1 are defined, and auxiliary discharge spaces S2, adjacent and connected to the main discharge spaces S1, are formed on a stepped surface of the barrier ribs 124 each having a base unit 124*a* with a wide width and a protrusion unit 124*b* with a narrow width. A scan electrode Y and an address electrode 122 are arranged to cross each other, and the auxiliary discharge spaces S2 are formed therebetween. A discharge voltage applied between the scan electrode Y and an address electrode 122 causes a discharge converging in the auxiliary discharge space S2 that is formed between a dielectric layer 114 (or a protective layer 115) covering the scan electrode Y and a top surface of the barrier ribs 124.

Figure 6:
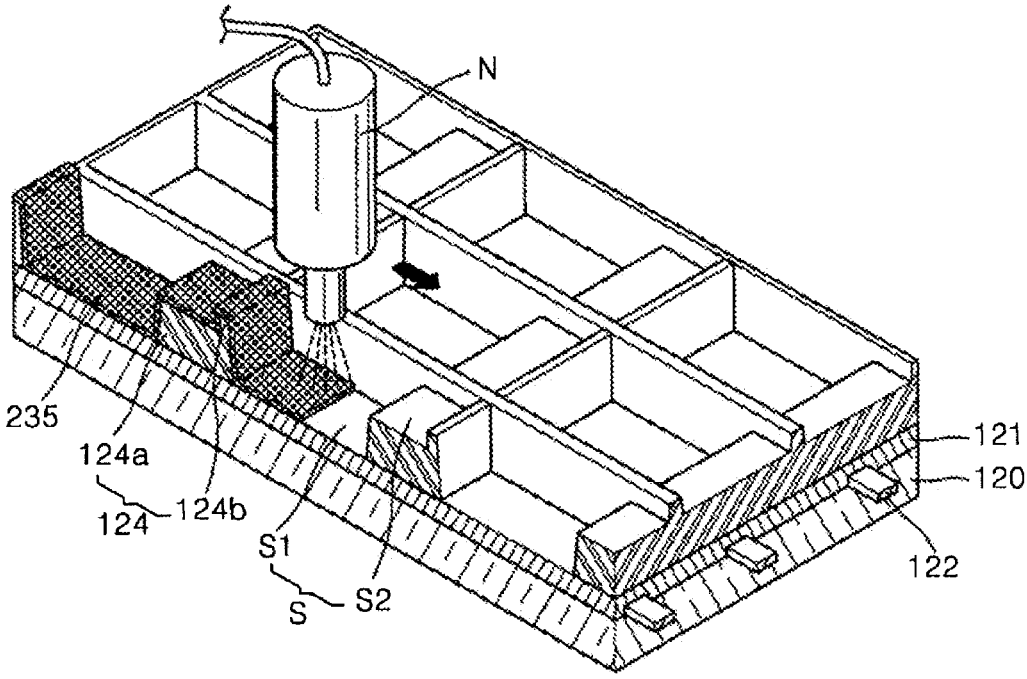
FIG. 6 is a perspective view illustrating a continuous coating process for forming an electron emission material layer illustrated in FIG. 5.

An electron emission material layer 235 is coated on a surface including a surface of the barrier ribs 124 and defines a boundary of the auxiliary discharge space S2, wherein the surface includes a top surface of the base unit 124*a*, and a first side 124*b*1 of the protrusion unit 124*b*. In the third embodiment, the electron emission material layer 235 is formed not only in the auxiliary discharge space S2 but also in the main discharge space S1. For example, as illustrated in FIG. 6, the electron emission material layer 235 of the auxiliary discharge space S2 and the electron emission material layer 235 of the main discharge space S1 may be formed as a continuous layer by a continuous coating process. In some embodiments, pasted electron emission materials are emitted while an injection nozzle N is moved from one edge of a substrate to another edge of the substrate such that the electron emission material layer 235 is continuously formed in the discharge spaces S1 and S2 in one direction. Also, a phosphor layer 125 may be formed together with the electron emission material layer 235 in the main discharge space S1. According to one embodiment, the phosphor layer 125 is formed on the electron emission material layer 235. In a display discharge, the electron emission material layer 235 formed on the main discharge space S1 reacts with a discharge electric field via gaps among phosphor particles and emits secondary electrons to the main discharge space S1, thereby activating a display discharge.

Fourth Embodiment

Figure 7:
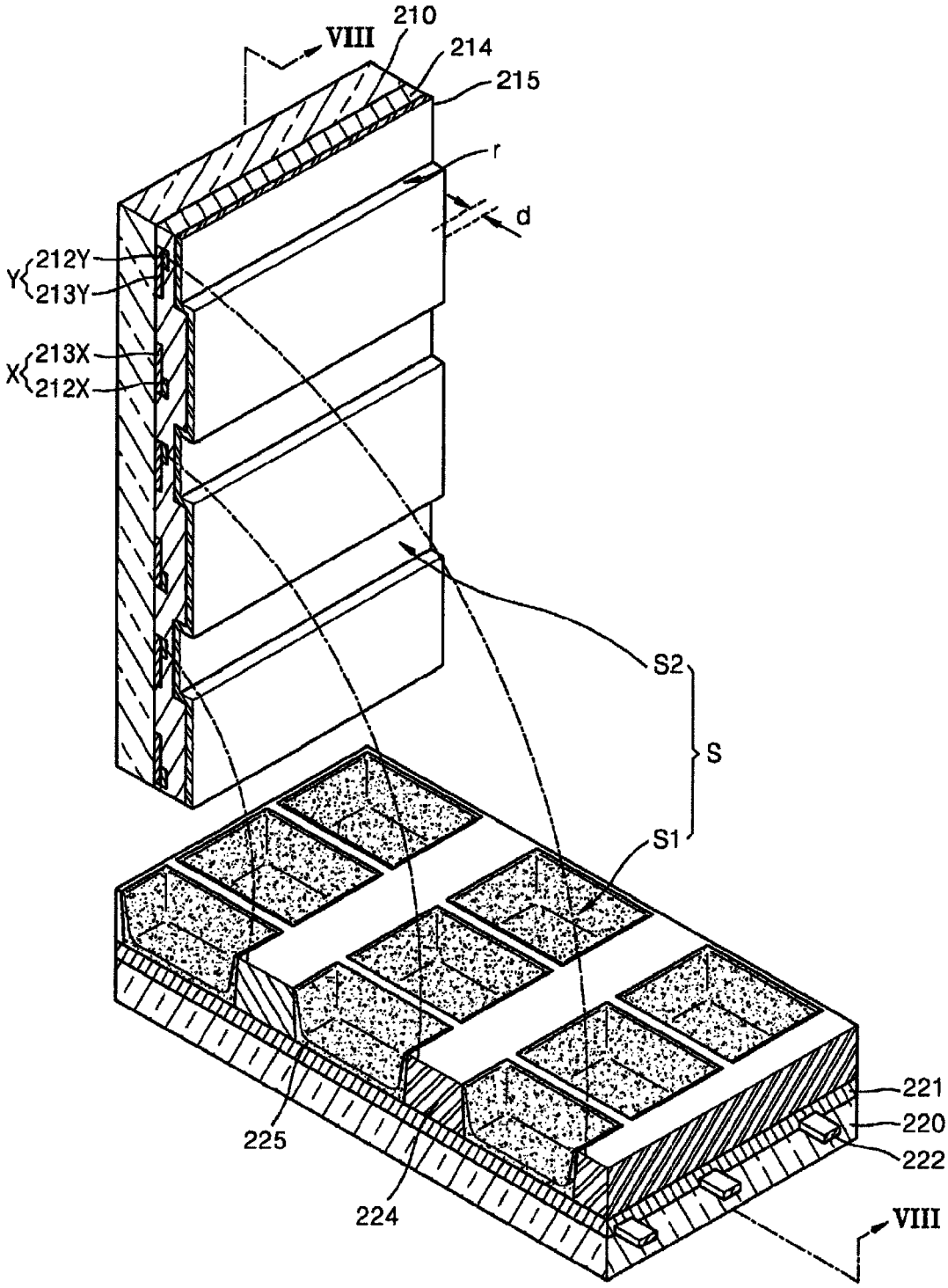
FIG. 7 is an exploded perspective view of a PDP according to a fourth embodiment of the present invention.
Figure 8:
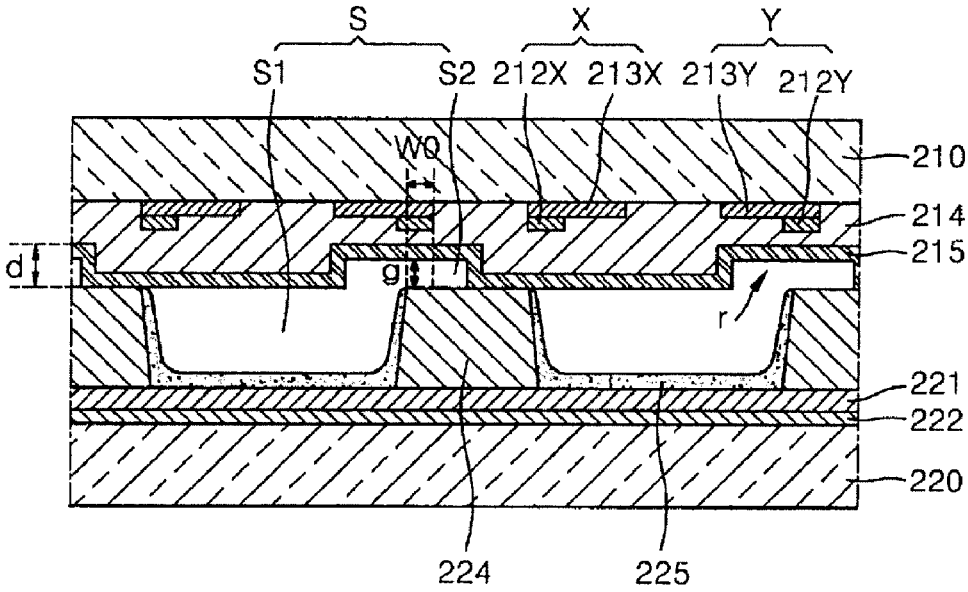
FIG. 8 is a vertical cross-sectional view of the PDP of FIG. 7, taken along the line VIII-VIII.

FIG. 7 is an exploded perspective view of a PDP according to a fourth embodiment of the present invention. FIG. 8 is a vertical cross-sectional view of the PDP of FIG. 7, taken along the line VIII-VIII. Referring to FIGS. 7 and 8, a plurality of barrier ribs 224 are interposed between a front substrate 210 and a rear substrate 220 to define main discharge spaces S1. A sustain electrode X and a scan electrode Y for generating a sustain discharge are disposed on the front substrate 210. An address electrode 222 for generating an address discharge with the scan electrode Y is disposed on the rear substrate 220. Each of the sustain electrode X and the scan electrode Y may respectively include bus electrodes 212X and 212Y and transparent electrodes 213X and 213Y, and may be covered with a dielectric layer 214. A protective layer 215 may be further formed on the dielectric layer 214. A dielectric layer 221 for covering the address electrode 222 is formed on the rear substrate 220.

The scan electrode Y and the barrier ribs 224 may be arranged so as to form an overlapping area having a width WO between the scan electrode Y and a barrier rib among the barrier ribs 224. In one embodiment, for the scan electrode Y including the bus electrode 212Y and the transparent electrode 213Y, a width overlapping area is formed between the barrier rib 224 and the bus electrode 212Y to which a discharge voltage is largely converged. In an address discharge, the dielectric layer 214 (or the protective layer 215) for covering the scan electrode Y and the barrier ribs 224 on the address electrode 222 constitute opposite discharge surfaces facing each other, and a discharge is generated mainly (or converges) in the auxiliary discharge spaces S2.

Different from the stepped barrier ribs 124 of the first embodiment (see FIG. 1), the barrier ribs 224 of the fourth embodiment have a flat top surface. That is, unlike in the first embodiment wherein a stepped space is formed on a part of the barrier ribs 224 so as to provide the auxiliary discharge spaces S2, in the fourth embodiment, grooves r are formed in parts of the dielectric layer 214, thereby forming the auxiliary discharge spaces S2 with respect to the barrier ribs 224. Here, a groove of the grooves r may be formed at a location corresponding to the scan electrode Y of the dielectric layer 214, and a main surface of the groove r and a top surface of the barrier ribs 124 may be disposed to face each other, so that the auxiliary discharge space S2 is formed therebetween. An address voltage applied between the scan electrode Y and the address electrode 222 causes a discharge in the auxiliary discharge space S2 that is between a main surface of the groove r and the top surface of the barrier ribs 224.

The auxiliary discharge space S2 receives the address discharge generated between the scan electrode Y and the address electrode 222. Thus, since the auxiliary discharge space S2 is in contact with the main discharge space S1, priming particles created by the address discharge are supplied to the adjacent main discharge space S1. The auxiliary discharge space S2 should have a sufficient volume to receive a proper amount of a discharge gas so that sufficient priming particles may be supplied via the address discharge. A depth d and a width of the groove r should have appropriate values so that the groove r is not dielectrically broken down by a firing voltage applied from the outside, and a withstand voltage characteristic is sufficiently realized therein.

Fifth Embodiment

Figure 9:
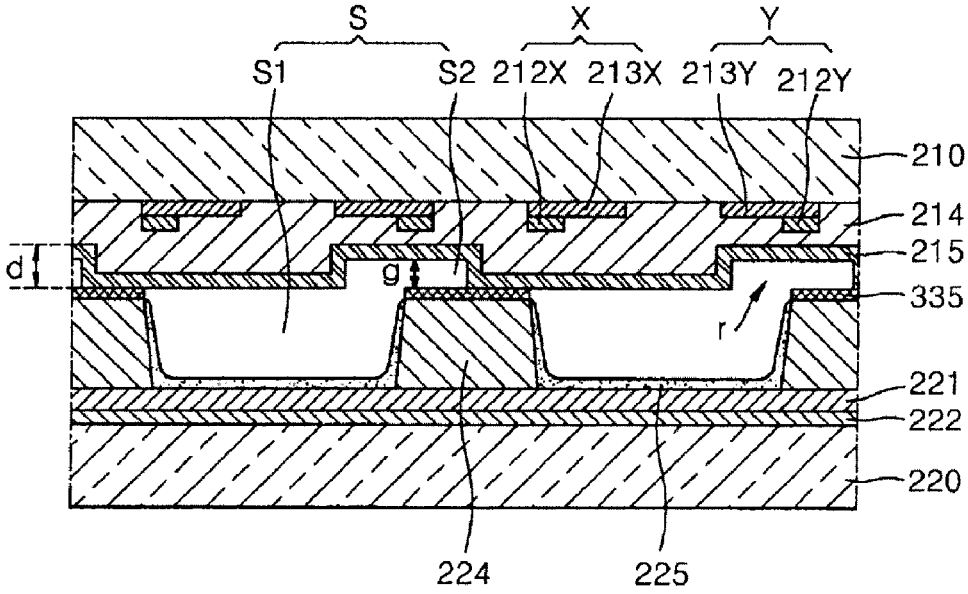
FIG. 9 is a vertical cross-sectional view of a PDP according to a fifth embodiment of the present invention.

FIG. 9 is a vertical cross-sectional view of a PDP according to a fifth embodiment of the present invention. Referring to FIG. 9, a plurality of barrier ribs 224 having a flat top surface are interposed between a front substrate 210 and a rear substrate 220 so that a plurality of main discharge spaces S1 are defined, and a plurality of auxiliary discharge spaces S2 are formed by grooves r formed in a dielectric layer 214. A discharge voltage applied between a scan electrode Y and an address electrode 222 causes a discharge converged in one of the auxiliary discharge spaces S2 which is between a main surface of one of the grooves r and a top surface of the barrier ribs 224.

An electron emission material layer 335 may be formed on the top surface of the barrier ribs 224 contacting the auxiliary discharge spaces S2, and the electron emission material layer 335 reacts with a high electric field due to the applied discharge voltage and emits secondary electrons inside of the auxiliary discharge spaces S2, thereby accelerating firing of a discharge. The electron emission material layer 335 may include MgO nano powder, Sr—CaO thin film, carbon powder, metal powder, MgO paste, ZnO, BN, MIS nano powder, OPS nano powder, ACE, CEL, etc.

Sixth Embodiment

Figure 10:
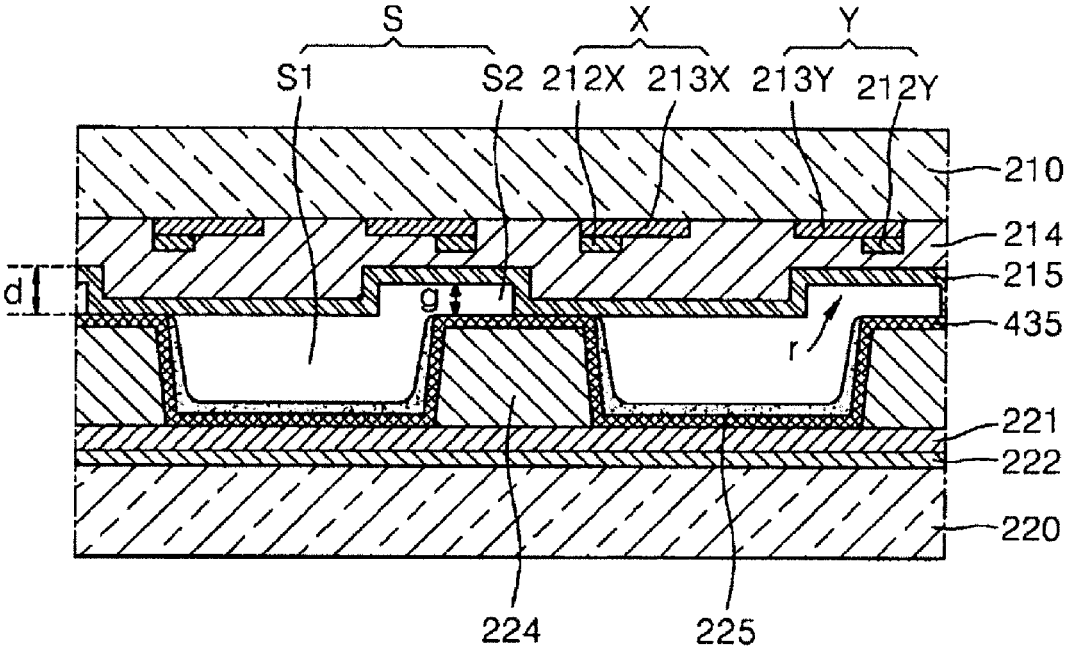
FIG. 10 is a vertical cross-sectional view of a PDP according to a sixth embodiment of the present invention.

FIG. 10 is a vertical cross-sectional view of a PDP according to a sixth embodiment of the present invention. In the sixth embodiment, an electron emission material layer 435 formed in an auxiliary discharge space S2 also extends to an area of a main discharge space S1. That is, the electron emission material layer 435 is formed not only in the auxiliary discharge space S2 but also in the main discharge space S1 by a continuous coating process. By coating pasted electron emission materials from one edge of a substrate to another edge of the substrate, the electron emission material layer 435 may be continuously formed along a desired direction (see FIG. 6). According to some embodiments of the present invention, the electron emission material layer 435 and a phosphor layer 225 may be formed together on an inner wall of the main discharge space S1. For example, the phosphor layer 225 may be formed on the electron emission material layer 435. Here, the electron emission material layer 435 covered with the phosphor layer 225 reacts with a discharge electric field via gaps among phosphor particles and supplies secondary electrons to the main discharge space S1, thereby enabling and activating a display discharge.

Method of Manufacturing Barrier Rib

Figure 11A:
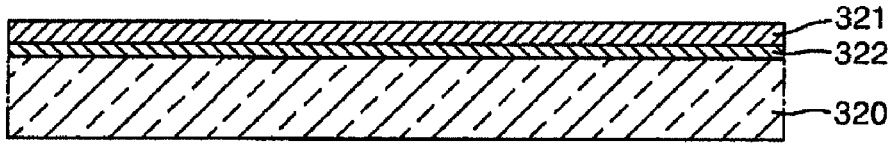
FIGS. 11A through 11F are vertical cross-sectional views for illustrating each of the processing stages of a method of manufacturing a stepped barrier rib pattern, according to an embodiment of the present invention.
Figure 11B:
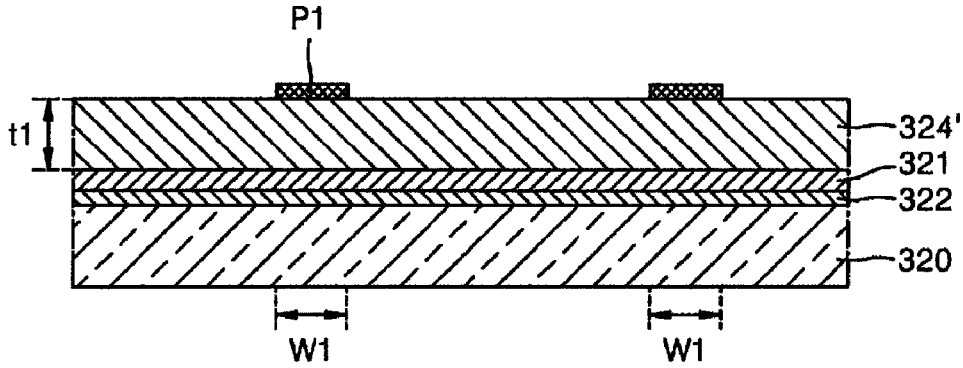
Figure 11C:
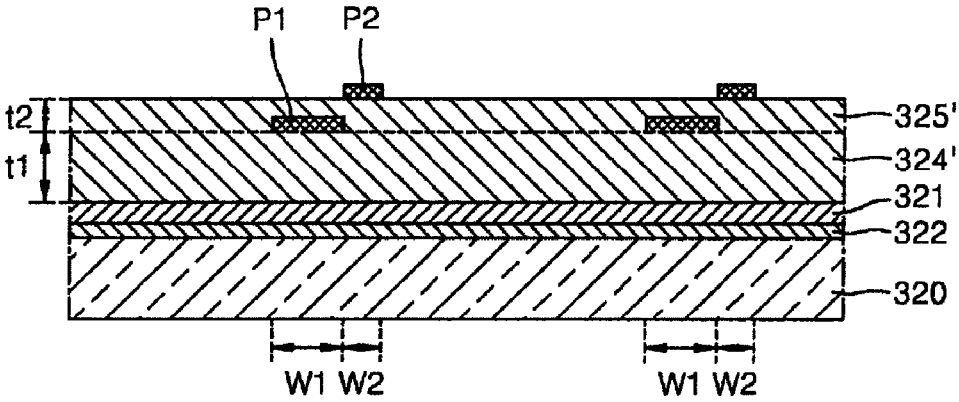
Figure 11D:
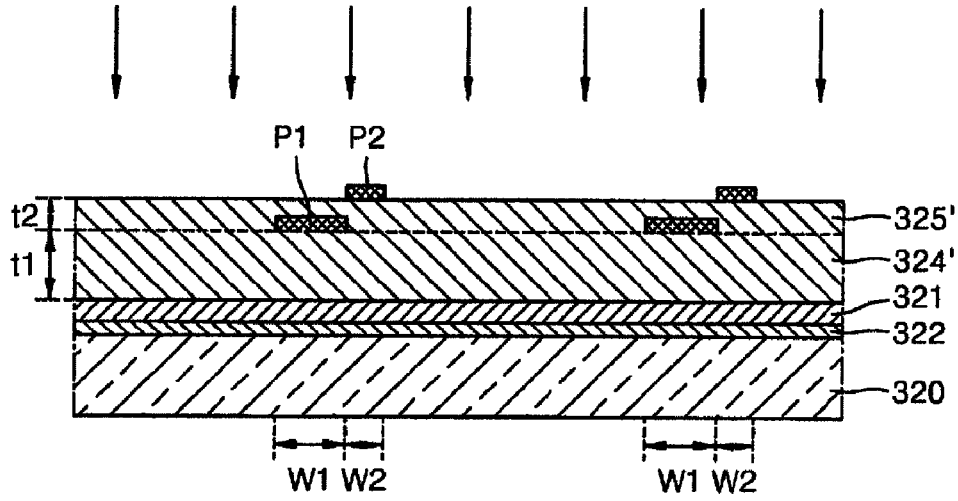
Figure 11E:
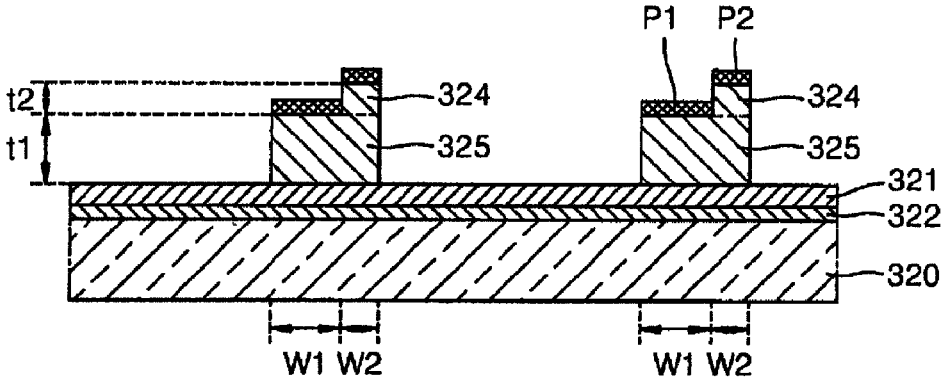
Figure 11F:
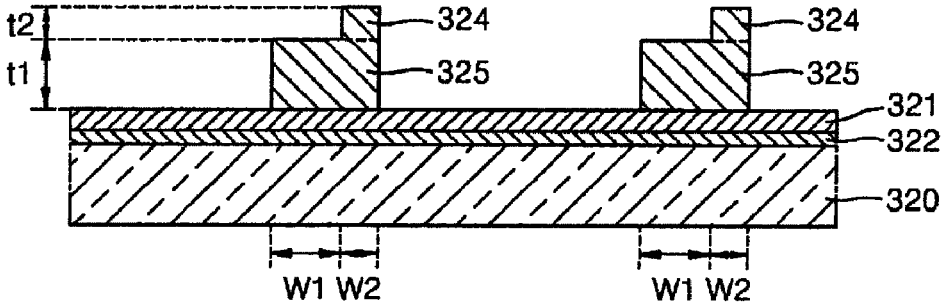

FIGS. 11A through 11F are vertical cross-sectional views for illustrating each of the processing stages of a method of manufacturing a stepped barrier rib according to one embodiment of the present invention. Referring to FIG. 11A, a rear substrate 320, for example, a glass substrate formed of a glass material or a flexible substrate formed of a polymer material is prepared, and an address electrode 322 is formed on the rear substrate 320. For example, the address electrode 322 may be formed by coating the entire rear substrate 320 with electrode materials such as aluminum, copper, silver, etc., and by using a proper patterning technology such as photo-lithography. Dielectric materials are coated on the entire rear substrate 320, thereby forming a dielectric layer 321 for covering the address electrode 322. Next, as illustrated in FIG. 11B, a first barrier rib raw material layer 324', which is a raw material of the barrier rib, is formed on the dielectric layer 321 with a thickness t1 (e.g., a predetermined thickness). For example, the first barrier rib raw material layer 324' may be formed by coating the dielectric layer 321 with a barrier rib paste including inorganic particles such as a glass frit powder to finally compose the barrier rib and various kinds of functional organic materials such as a carrier to make a paste of the inorganic particles, an adhesive material providing adhesiveness between the inorganic particles, etc. Next, a first photoresist pattern P1 for covering a first area W1 of the barrier rib is formed on the first barrier rib raw material layer 324'. Here, the first area W1 of the barrier rib corresponds to a width of a base unit 324 which is exposed to the outside from a desired stepped shape of the barrier rib. Next, as illustrated in FIG. 11C, a second barrier rib raw material layer 325' is formed on the first photoresist pattern P1. Here, a thickness t2 of the second barrier rib raw material layer 325' is proportional to a height of an auxiliary discharge space provided by the stepped shape of the barrier rib to be finally completed, and thus, the thickness t2 should be formed within a proper thickness range. Then, a second photoresist pattern P2 for covering a second area W2 of the barrier rib is formed on the second barrier rib raw material layer 325'. Here, the second area W2 of the barrier rib corresponds to a width of a protrusion unit 325 in the desired stepped shape of the barrier rib. Next, as illustrated in FIG. 11D, the photoresist patterns P1 and P2 for covering the specific areas W1 and W2 are used as an etch barrier so that a etching process (e.g., a predetermined etching process) is performed on the first and second barrier rib raw material layers 324' and 325'. For example, a sandblasting method with an abrasion effect of particles sprayed by high pressure air may be used in the etching process. After such etching process is performed, as illustrated in FIG. 11E, the stepped barrier rib shape having the base unit 324 and the protrusion unit 325 is obtained. After that, as illustrated in FIG. 11F, the photoresist patterns P1 and P2 are stripped. If necessary, a high temperature baking process is performed, so that the barrier rib having a hardened shape may be obtained.

Figure 12A:
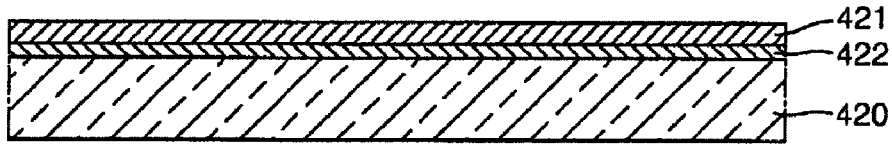
FIGS. 12A through 12E are vertical cross-sectional views for illustrating each of the processing stages of a method of manufacturing a stepped barrier rib pattern, according to another embodiment of the present invention.
Figure 12B:
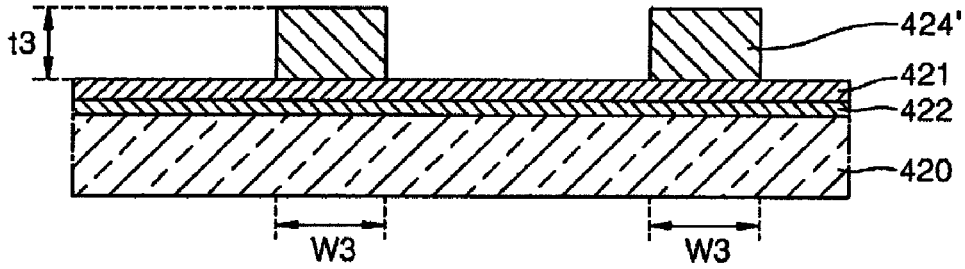
Figure 12C:
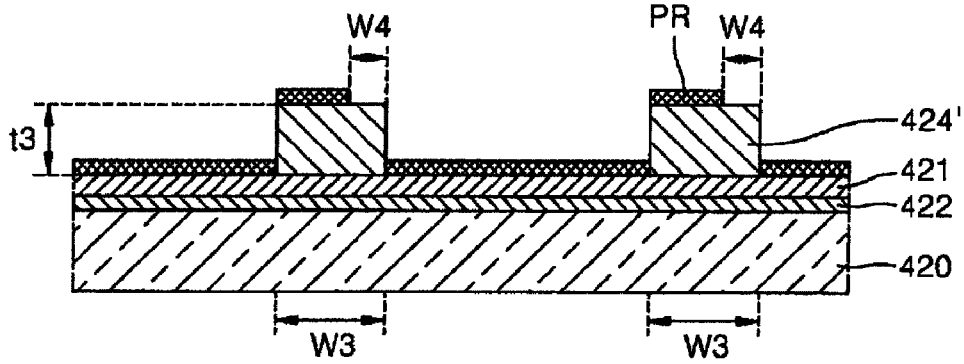
Figure 12D:
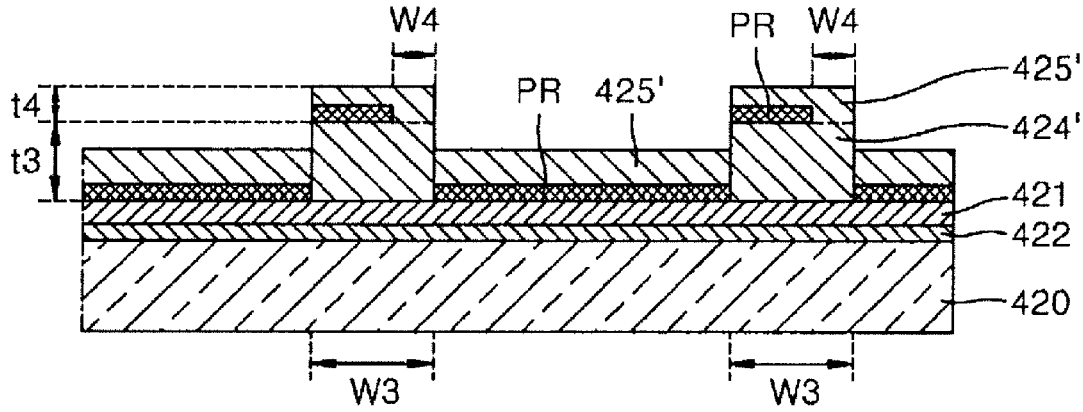
Figure 12E:
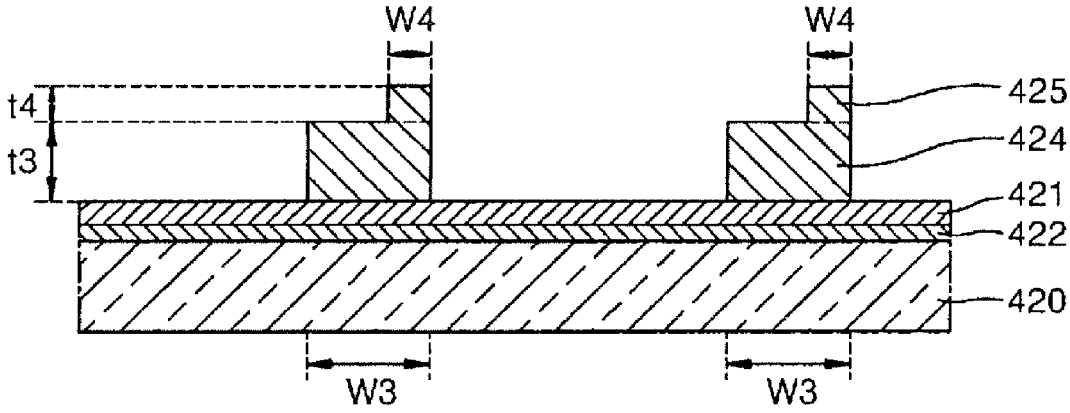

FIGS. 12A through 12E are vertical cross-sectional views for illustrating each of the processing stages of another method of manufacturing a stepped barrier rib pattern, according to another embodiment of the present invention. First, as illustrated in FIG. 12A, a rear substrate 420, for example, a glass substrate formed of a glass material or a flexible substrate formed of a polymer material is prepared, and an address electrode 422 is formed on the rear substrate 420. Next, dielectric materials are coated on the entire rear substrate 420, thereby forming a dielectric layer 421 for covering the address electrode 422. As illustrated in FIG. 12B, a barrier rib paste is coated with a thickness t3 (e.g., a predetermined thickness) on the dielectric layer 421, and then a barrier rib pattern 424' corresponding to a third area W3 of a barrier rib is formed by using an etching process. Here, the third area W3 of the barrier rib corresponds to an overall width of a desired barrier rib shape. Next, as illustrated in FIG. 12C, a photoresist thin film PR is coated on the entire dielectric layer and the barrier rib pattern 424', then a part of the photoresist thin film PR corresponding to a fourth area W4 of the barrier rib is selectively removed by using, for example, a photo-lithography process. Here, the fourth area W4 of the barrier rib corresponds to a width of a protrusion unit 425 (shown in FIG. 12E) in a completed barrier rib shape. Next, as illustrated in FIG. 12D, a barrier rib paste 425' is coated with a thickness t4 (e.g., a predetermined thickness) on the entire photoresist thin film PR. Then, a lift-off process is performed by stripping the photoresist thin film PR so as to selectively remove the barrier rib paste 425' formed thereon. Here, the barrier rib paste 425' of all parts other than the fourth area W4 of the barrier rib is removed such that, as illustrated in FIG. 12E, the stepped shape barrier rib having the protrusion unit 425 and a base unit 424 is formed. After that, if necessary, a high temperature (e.g., a predetermined high temperature) baking process may be performed.

A PDP according to the embodiments of the present invention does not include phosphor layers in some areas of unit cells S to which the address discharge converges, thereby preventing or reducing the discharge interference caused by the unique electrical property of the phosphor layer during the address discharge. Accordingly, the address voltage margin is increased, and discharge stability and sufficient discharge effect are obtained with a low address voltage, so that a high Xe plasma display with enhanced luminous efficiency can be obtained. Thus, the requirement for reducing power consumption of a full-HD display device can be satisfied.

Also, the embodiments of the present invention can remove or reduce the discharge light or the background light during the address discharge, so that the HD display has a high contrast.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A plasma display panel comprising:

a first substrate and a second substrate facing each other;

a plurality of barrier ribs on the second substrate between the first substrate and the second substrate forming a plurality of main discharge spaces and a plurality of auxiliary discharge spaces along a stepped surface of the barrier ribs, each of the barrier ribs comprising a base unit and a protrusion unit protruding from the base unit, the base unit having a relatively large width in comparison to a width of the protrusion unit;

pairs of scan electrodes and sustain electrodes extending on the first substrate, the scan electrodes at locations overlapping with or adjacent to the auxiliary discharge spaces;

a plurality of address electrodes for generating address discharges together with the scan electrodes;

a plurality of phosphor layers respectively in the main discharge spaces; and a discharge gas in the main discharge spaces and the auxiliary discharge spaces, wherein the phosphor layers are not coated inside the auxiliary discharge spaces.

2. The plasma display panel of claim 1, wherein the main discharge spaces and the auxiliary discharge spaces are adjacent and contiguous.

3. The plasma display panel of claim 1, wherein the barrier ribs face the scan electrodes, and the auxiliary discharge spaces are formed therebetween.

4. The plasma display panel of claim 1, further comprising an electron emission material layer on the stepped surface of the barrier ribs.

5. The plasma display panel of claim 4, wherein the electron emission material layer extends to the main discharge spaces.

6. The plasma display panel of claim 5, wherein the electron emission material layer continuously extends between the main discharge spaces and the auxiliary discharge spaces.

7. A plasma display panel comprising:

a first substrate and a second substrate facing each other;

a plurality of barrier ribs on the second substrate between the first substrate and the second substrate forming a plurality of main discharge spaces and a plurality of auxiliary discharge spaces along a stepped surface of the barrier ribs;

pairs of scan electrodes and sustain electrodes extending on the first substrate, the scan electrodes at locations overlapping with or adjacent to the auxiliary discharge spaces;

a plurality of address electrodes for generating address discharges together with the scan electrodes;

a plurality of phosphor layers respectively in the main discharge spaces;

a discharge gas in the main discharge spaces and the auxiliary discharge spaces; and an electron emission material layer on the stepped surface of the barrier ribs, wherein the electron emission material layer extends to the main discharge spaces, and, wherein the phosphor layers are on sections of the electron emission material layer located in the main discharge spaces.

8. A plasma display panel comprising:

a first substrate and a second substrate facing each other;

a plurality of barrier ribs on the second substrate between the first substrate and the second substrate forming a plurality of main discharge spaces;

pairs of scan electrodes and sustain electrodes extending on the first substrate;

a dielectric layer covering the pairs of scan electrodes and sustain electrodes and having a plurality of grooves forming a plurality of auxiliary discharge spaces at locations overlapping with the scan electrodes, wherein each of the scan electrodes is overlapped with a corresponding one of the grooves and a corresponding one of the barrier ribs, each of the discharge spaces being closed at one end by a structure including a protective part covering the dielectric layer;

a plurality of address electrodes for generating address discharges together with the scan electrodes;

a plurality of phosphor layers respectively in the main discharge spaces; and a discharge gas in the main discharge spaces and the auxiliary discharge spaces.

9. The plasma display panel of claim 8, wherein the main discharge spaces and the auxiliary discharge spaces are adjacent and connected to each other.

10. The plasma display panel of claim 8, wherein the barrier ribs face the scan electrodes, and the auxiliary discharge spaces are formed therebetween.

11. The plasma display panel of claim 8, further comprising an electron emission material layer on top surfaces of the barrier ribs, the electron emission material layer defining the auxiliary discharge spaces.

12. The plasma display panel of claim 11, wherein the electron emission material layer extends to the main discharge spaces.

13. The plasma display panel of claim 12, wherein the electron emission material layer continuously extends between the main discharge spaces and the auxiliary discharge spaces.

14. A plasma display panel comprising:

a first substrate and a second substrate facing each other;

a plurality of barrier ribs on the second substrate between the first substrate and the second substrate forming a plurality of main discharge spaces;

pairs of scan electrodes and sustain electrodes extending on the first substrate;

a dielectric layer covering the pairs of scan electrodes and sustain electrodes and having a plurality of grooves forming a plurality of auxiliary discharge spaces at locations overlapping with or adjacent to the scan electrodes;

a plurality of address electrodes for generating address discharges together with the scan electrodes;

a plurality of phosphor layers respectively in the main discharge spaces;

a discharge gas in the main discharge spaces and the auxiliary discharge spaces; and an electron emission material layer on top surfaces of the barrier ribs, the electron emission material layer defining the auxiliary discharge spaces, wherein the electron emission material layer extends to the main discharge spaces, and wherein the phosphor layers are on sections of the electron emission material layer in the main discharge spaces.

15. A plasma display panel comprising:

a first substrate and a second substrate facing each other;

a plurality of barrier ribs on the second substrate between the first substrate and the second substrate, each of the barrier ribs comprising a base unit forming a plurality of cells and a protrusion unit protruding from a part of the base unit, wherein a width of the protrusion unit is narrower than a width of the base unit;

pairs of scan electrodes and sustain electrodes alternately arranged on the first substrate;

a plurality of phosphor layers respectively at at least a part of the plurality of cells; and a discharge gas in the plurality of cells, wherein each of the scan electrodes overlaps with at least a part of the base unit of a corresponding barrier rib of the barrier ribs, wherein the phosphor layers are not coated on a surface of the base unit facing the first substrate and adjacent to the protrusion unit.

16. The plasma display panel of claim 15, wherein the protrusion unit protrudes from a part of the base unit that is distant from a center of an adjacent cell among the plurality of cells.

17. A plasma display panel comprising:

a first substrate and a second substrate facing each other;

a plurality of barrier ribs on the second substrate between the first substrate and the second substrate and forming a plurality of cells;

pairs of scan electrodes and sustain electrodes extending on the first substrate;

a dielectric layer covering the pairs of scan electrodes and sustain electrodes and having grooves at locations overlapping with the scan electrodes, wherein each of the scan electrodes is overlapped with a corresponding one of the grooves and a corresponding one of the barrier ribs, each of the cells being closed at one end by a structure including a protective part covering the dielectric layer;

a plurality of phosphor layers respectively at least a part of the plurality of cells; and a discharge gas filled in the plurality of cells.

* * * * *